US007025231B2

(12) United States Patent
Rutherford et al.

(10) Patent No.: US 7,025,231 B2
(45) Date of Patent: Apr. 11, 2006

(54) CONTAINER FOR CONSUMER PRODUCTS WITH CONCEALED STRETCH RELEASE ADHESIVE STRUCTURE

(75) Inventors: Keith Leslie Rutherford, Palatine, IL (US); Mark Gregory Neuhalfen, Mt. Prospect, IL (US)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 187 days.

(21) Appl. No.: 10/379,964

(22) Filed: Mar. 5, 2003

(65) Prior Publication Data

US 2004/0026426 A1 Feb. 12, 2004

Related U.S. Application Data

(63) Continuation-in-part of application No. 10/213,227, filed on Aug. 6, 2002.

(51) Int. Cl.
*B67D 5/058* (2006.01)

(52) U.S. Cl. ..... 222/181.3; 222/212; 222/491; 248/205.3

(58) Field of Classification Search .. 222/181.1–181.3, 222/490, 491, 212; 248/205.3
See application file for complete search history.

(56) References Cited

U.S. PATENT DOCUMENTS

| | | | | |
|---|---|---|---|---|
| 3,900,059 | A * | 8/1975 | Kirk et al. | 383/11 |
| 4,024,312 | A | 5/1977 | Korpman | 428/343 |
| 4,470,523 | A * | 9/1984 | Spector | 222/181.2 |
| 4,793,517 | A | 12/1988 | Washnut | 222/129 |
| 5,022,625 | A | 6/1991 | Klinkhardt | 248/309.2 |
| 5,924,605 | A * | 7/1999 | Baudin et al. | 222/494 |
| 6,001,471 | A * | 12/1999 | Bries et al. | 428/343 |
| 6,004,665 | A | 12/1999 | Luhmann et al. | 428/317.3 |
| 6,406,781 | B1 | 6/2002 | Hamerski | 428/317.3 |
| 2002/0009568 | A1 | 1/2002 | Bries et al. | 428/40.1 |

FOREIGN PATENT DOCUMENTS

| | | |
|---|---|---|
| WO | 92/11332 | 7/1992 |
| WO | 92/11333 | 7/1992 |
| WO | 02/04571 | 1/2002 |

OTHER PUBLICATIONS

Co-pending Application: Rutherford et al., U.S. Appl. No. 10/213,277; filed Aug. 6, 2002.
Technical Service Product Information, 3M™ Command™ Adhesive Strips (Bulk and Retail OEM), Nov. 5, 1999.

* cited by examiner

*Primary Examiner*—Michael Mar
*Assistant Examiner*—Melvin A. Cartagena
(74) *Attorney, Agent, or Firm*—Karen E. Klumas

(57) ABSTRACT

A container for a consumer product suitable for mounting on a wall, the container comprising: a stretch release adhesive structure located at least partially on the one or more side surfaces; and an outer label substantially covering the stretch release adhesive structure. In a preferred embodiment of the invention the container includes an inner label, in order to provide additional instructions, following removal of the outer label and/or to provide a mechanism by which to effect easy removal of the container from the wall.

16 Claims, 7 Drawing Sheets

CONTAINER FOR CONSUMER PRODUCTS WITH CONCEALED STRETCH RELEASE ADHESIVE STRUCTURE

This is a continuation-in-part of application Ser. No. 10/213,227, filed Aug. 6, 2002.

FIELD OF THE INVENTION

The present invention relates to containers that may, but do not have to be, mounted on a wall by virtue of comprising a concealed stretch release adhesive structure.

BACKGROUND OF THE INVENTION

Conventional storage and dispensing containers, whether made of glass, metal or plastics, are generally stored on a shelf or floor, with the bottom or top surface of the container supporting it on the shelf, or the like. Such conventional containers, therefore, require horizontal space or area for their storage, which often is not available, or available only to a limited degree, particularly at a location where it would be most convenient (e.g. shower wall).

Mounting containers on a wall is known in the art. See, e.g. Washnut, U.S. Pat. No. 4,793,517; Spector, U.S. Pat. No. 4,470,523; Klinkhardt, U.S. Pat. No. 5,022,625. Pressure sensitive and/or stretch release have been described by U.S. Pat. No. 4,024,312; WO 92/11332; WO 92/11333; Hamerski, U.S. Pat. No. 6,406,781; Bries et al., U.S. Pat. No. 6,001,471; WO 20/010507; Bries et al., US 2002/0009568 and Luhmann et al, U.S. Pat. No. 6,004,665. WO 02/04571 discloses wet-resistant stretch release adhesives.

The stretch release adhesive structures are typically not aesthetically appealing when attached to the side of the container, especially when the container is not mounted on the wall. They protrude beyond the side wall of the container, e.g. into the orifice/neck area of the container. There is a need to have containers that are aesthetically pleasing even when not mounted on the wall, yet are equipped with the stretch release adhesive structure, so that they can be mounted on the wall at a time of choosing. Such containers would obviate the need for manufacturing a separate line of wall-mounted containers, i.e. the same line of product may be used on the horizontal counter of shelf space as well as being mounted on the wall and be equally aesthetically pleasing.

SUMMARY OF THE INVENTION

The present invention includes a container for a consumer product suitable for mounting on a wall, the container comprising:

(a) one or more side surfaces, an end surface and a surface comprising an orifice;

(b) a stretch release adhesive structure located at least partially on the one or more side surfaces;

(c) an outer label substantially covering the stretch release adhesive structure.

The present invention provides a container of various uses, sizes and shapes, which may equally well be utilized on a horizontal or a vertical surface. The inventive container is equipped with a stretch release adhesive (hereinafter "SRA") structure, yet the SRA structure is located on the side surface of the container and is covered or concealed by an outer label, the label preferably carrying printed instructions for the use of the container, e.g. mounting on the wall and dispensing the product or information about the product.

By virtue of positioning the SRA structure on the side wall and covering it with the outer label, the SRA structure is not visible when the container is stored or used on a horizontal surface, yet the container may be wall-mounted if so desired. The inventive container obviates the need for marketing separate lines of traditional and wall-mountable containers for the same brand of product. An additional advantage of the outer label is to provide a tamper and damage protection to the SRA structure. In the preferred embodiments of the invention, the container further includes an inner label, which makes for an easier removal of the container from the wall, the inner label preferably also carrying printed instructions for the removal of the SRA structure from the wall or information about the product.

The following detailed description and the drawings illustrate some of the effects of the inventive compositions. The invention and the claims, however, are not limited to the following description and drawings.

BRIEF DESCRIPTION OF THE DRAWINGS

FIG. 11 is an enlarged cross-section of the valve construction for the container in FIGS. 1–4.

DETAILED DESCRIPTION OF THE INVENTION

Except in the examples, or where otherwise explicitly indicated, all numbers in this description indicating amounts of material or conditions of reaction, physical properties of materials and/or use are to be understood as modified by the word "about."

For the avoidance of doubt the word "comprising" is intended to mean "including" but not necessarily "consisting of" or "composed of." In other words, the listed features or options need not be exhaustive.

"Located Completely on a Side Surface" with regard to a SRA structure and/or a label means that a direct frontal visual view of the container does not reveal any part of the stretch release adhesive structure and/or a label, prior to removal of the outer label.

"Substantially covering" as used herein means that the outer label substantially conceals the SRA structure from view, however the outer label does not have to be adhered along the label's entire perimeter, or one may be able to glimpse a minimal part of the SRA structure.

"Consumer product" or "Product" are used interchangeably and includes but is not limited to food or household or personal care products, such as, for instance, shampoos, hair conditioners, shower gels, air fresheners, lotions, skin cosmetics, laundry detergent or laundry care compositions, the products being in any physical form including but not limited to liquids, solids, aerosols, gels, slurries, pastes, separable items (e.g., capsules or tablets or individually wrapped packages).

"Inverted" means that, when wall-mounted, the exit orifice of the container is located in a position that is below its midpoint as defined by its center of gravity.

Figure 4:
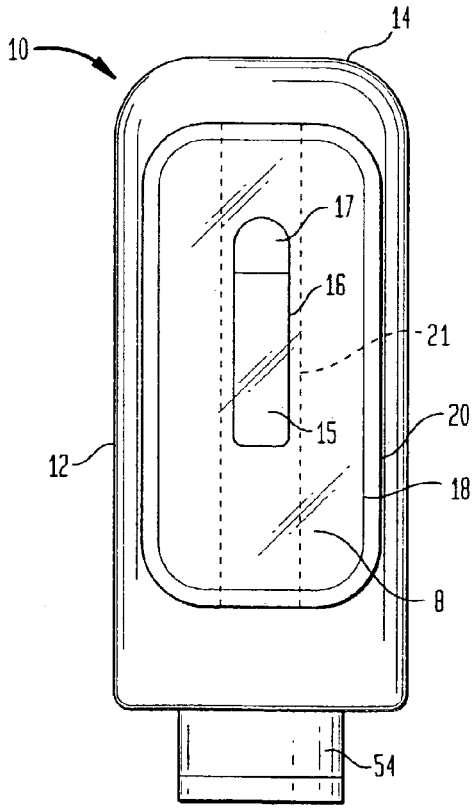
Figure 5:
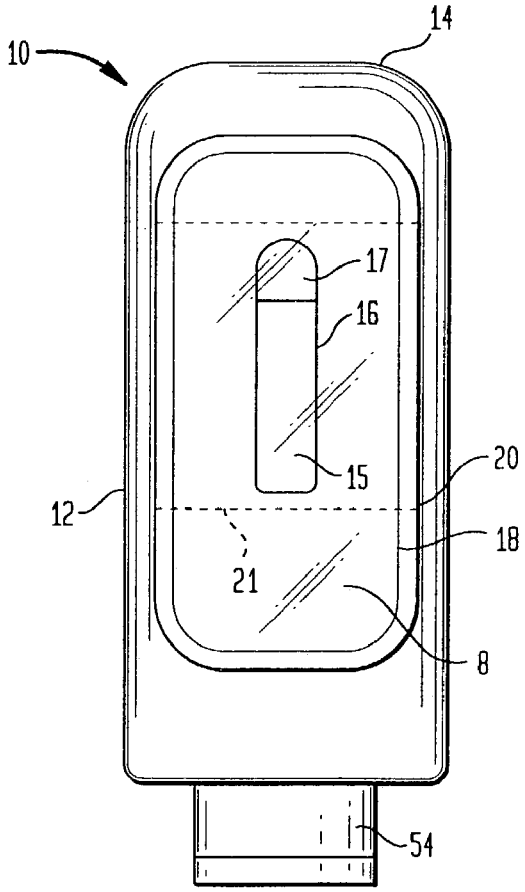
Figure 6:
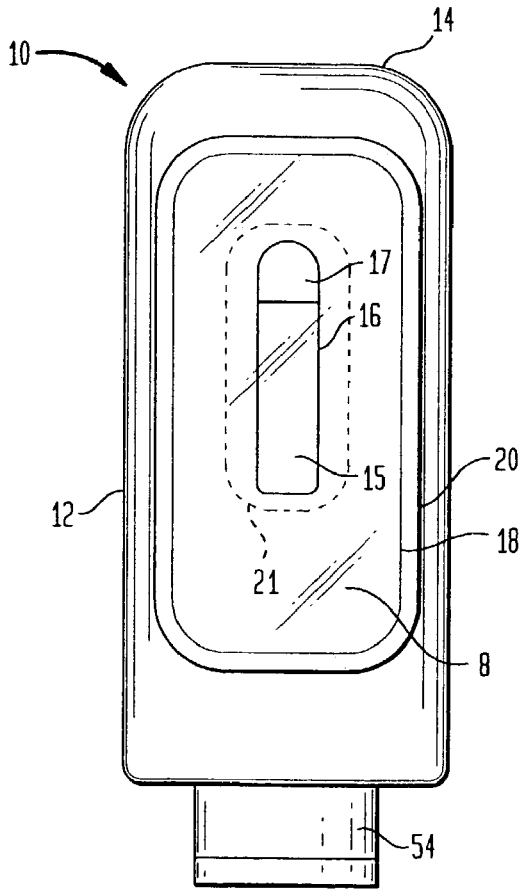
Figure 7:
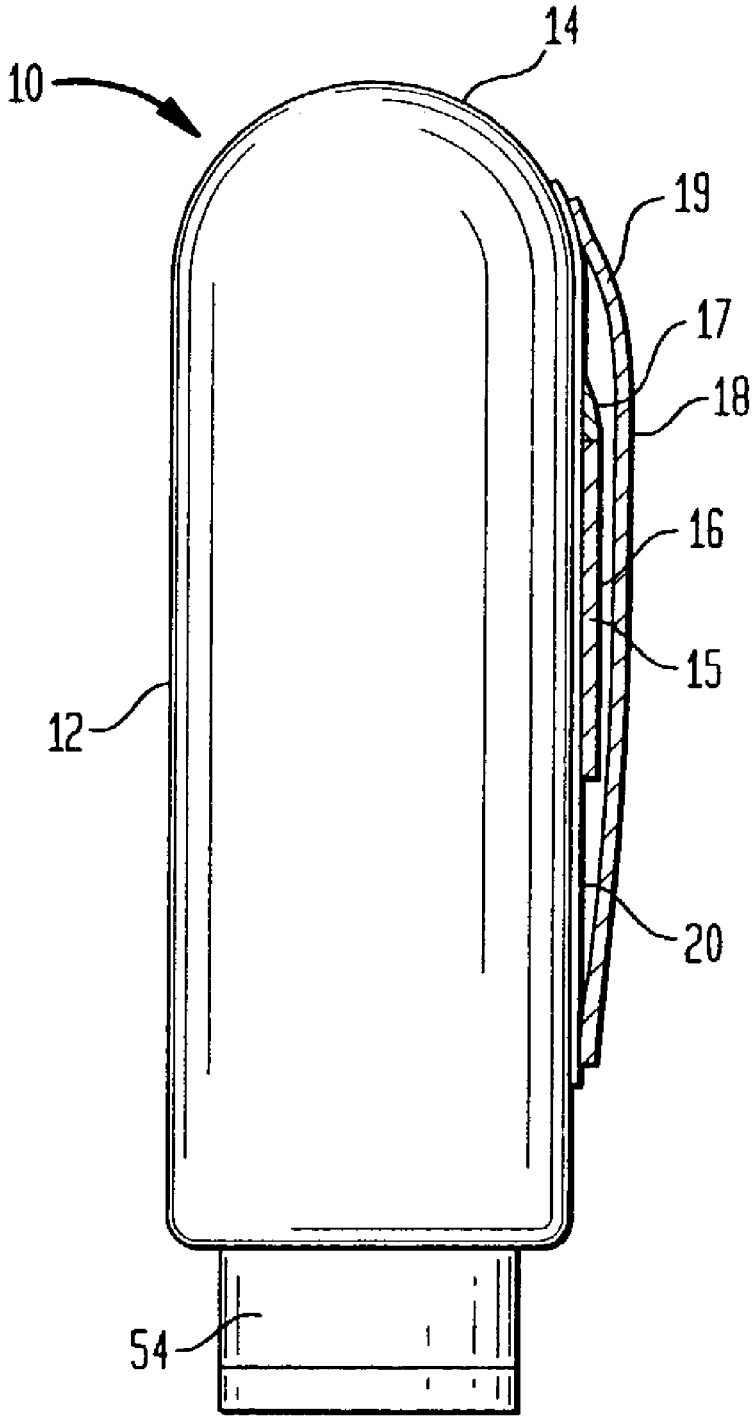
FIG. 7 is a side cross-sectional view of the container of FIG. 3 along line 2—2.

Referring now to the drawings in greater detail, FIGS. 1–10 show a container 10, in inverted orientation, that may be used for storing and dispensing the consumer product 8. The container may be pressurized with a compressed or liquified propellant gas and may be made of metal, a thermoplastic resin material or other plastics or paper or other suitable materials. Container 10 (prior to attaching the SRA structure and the label(s)) may be made by methods which are known in the art or by methods which are analogous to those which are known in the art. Container 10 may have a convex shaped end surface 14, and a continuous side surface 12. Container 10 also has SRA structure 16, located on the side surface 12. The SRA structure preferably comprises an adhesive part 15 and a non-adhesive tab 17, the non-adhesive part facilitating the removal of the SRA structure from the wall. The SRA structure is covered by an outer label 18, to conceal the SRA structure and to protect it from tampering. The outer label 18 is peeled off whenever the consumer desires to mount the container on the wall (the wall is not shown). The SRA structure may be adhered directly (temporarily adhered or permanently bonded) to the side surface 12, as in FIGS. 1 and 2. When the SRA structure is located completely on the side surface of the container, as in one of the preferred embodiments of the present invention, and the container is mounted on the wall, the non-adhesive tab 17 of the SRA structure 16, is not protruding and is not available for pulling by hand. Thus, preferably, in order to achieve an easier removal of the container from the wall, an inner label 20 is included, as shown in FIGS. 3–7. The inner label 20 is adhered to both the container and SRA. When the user elects to remove the container by pulling it away from the wall, a portion or the whole of the inner label becomes detached from the container's side surface to leave only the stretch release adhesive structure and label remaining attached to the wall. This can then be removed using the stretch release adhesive tab. FIGS. 4–6 show preferred embodiments of the invention, wherein the inner label 20 contains perforated line or lines 21, to facilitate the ease of container removal from the wall.

Figure 1:
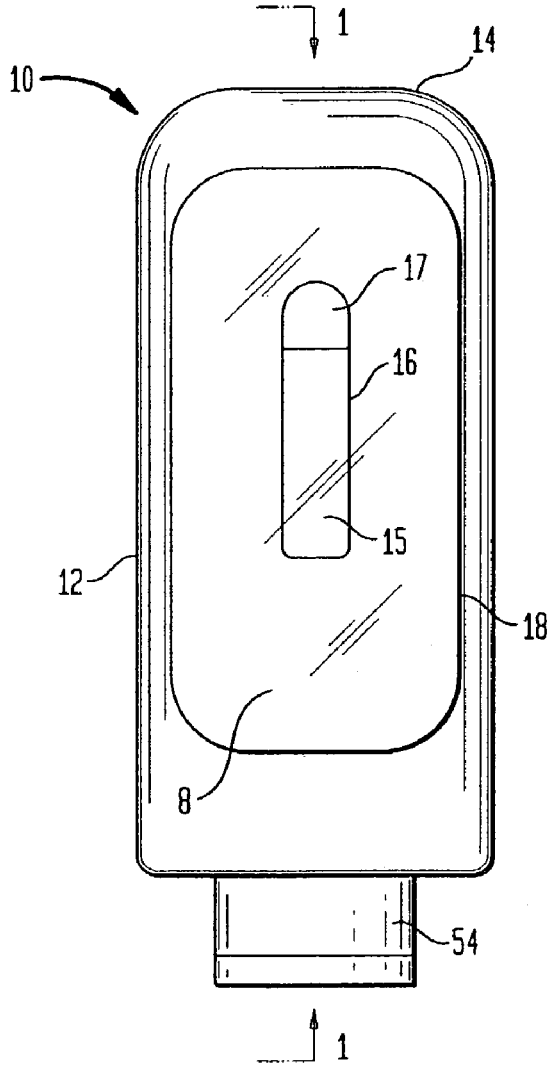
FIG. 1 is a front planar view of one of the embodiments of the container of the invention in the inverted position; the container and all its features being depicted as transparent, to facilitate the understanding of the invention.
Figure 2:
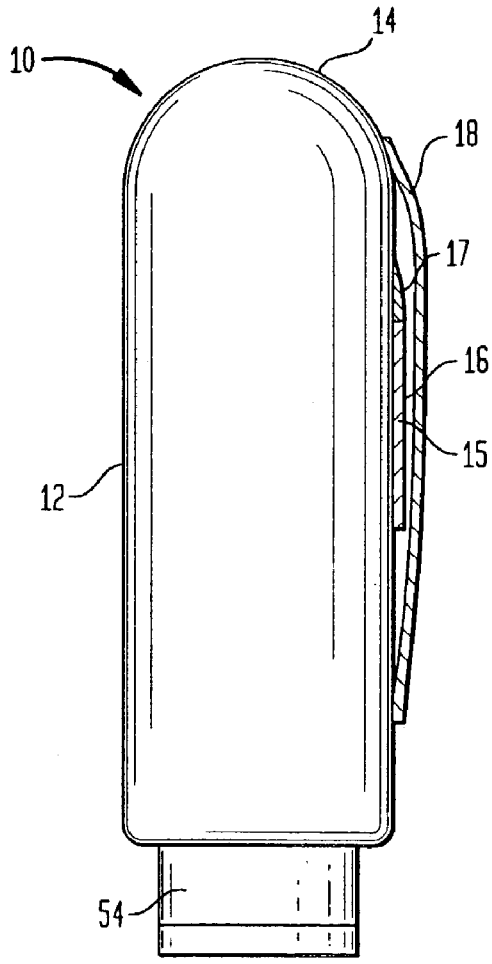
FIG. 2 is a side cross-sectional view of the container of FIG. 1 along line 1—1.
Figure 3:
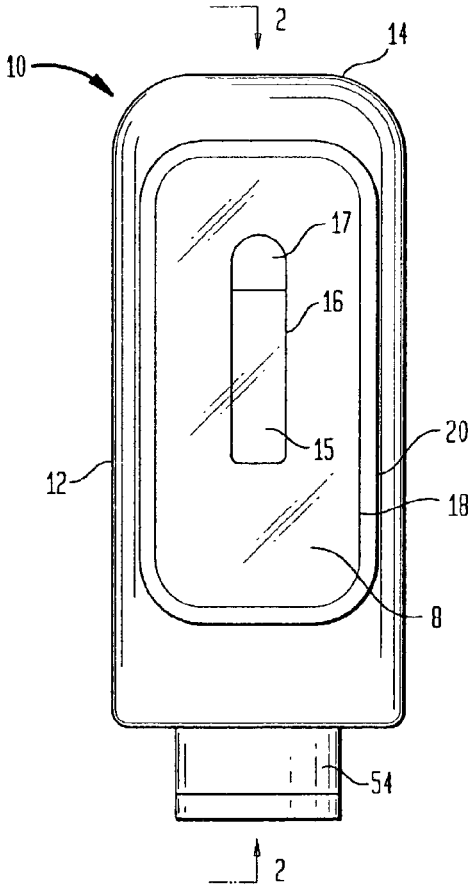
FIGS. 3 through 6 are front planar views of some of the embodiments of the containers of the invention in the inverted position; the containers and all their features being depicted as transparent, to facilitate the understanding of the invention.

When the inner label is not included, as for instance in FIGS. 1 and 2, then the container may be removed by the SRA structure becoming internally separated into two parts along its centre plane to leave part of the SRA structure attached to the wall and part to the container.

Figure 8:
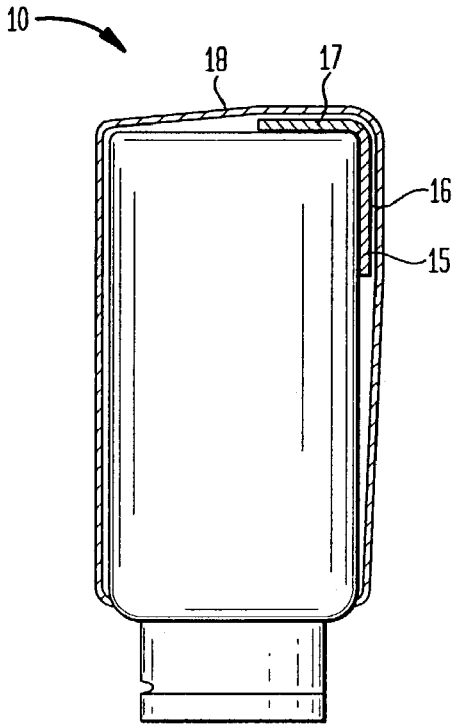
FIGS. 8 through 11 are side cross sectional views of other preferred embodiments of the inventive container—FIGS. 8 and 9 with the outer label in place and FIG. 10 depicting the appearance of the container upon removal of the outer label.
Figure 9:
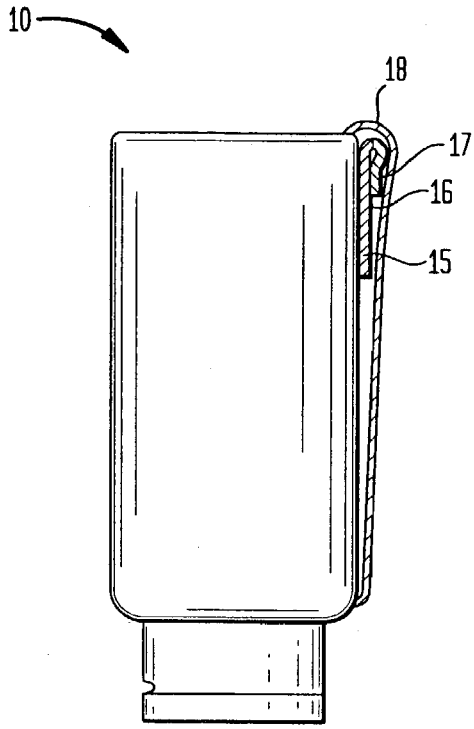
Figure 10:
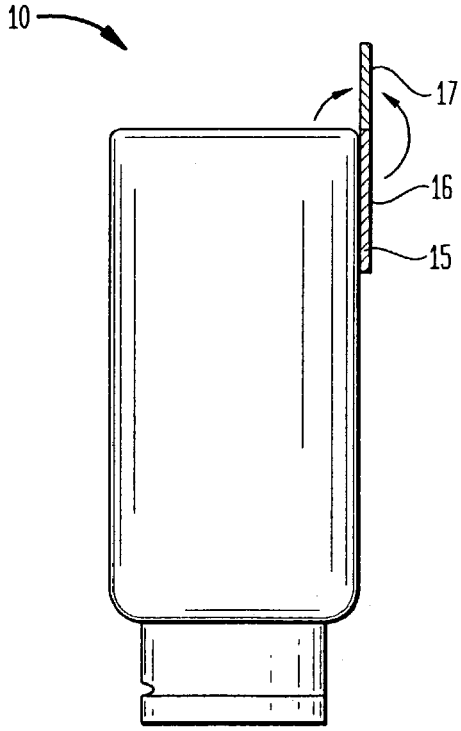

In the alternative, as shown in FIGS. 8–10, the SRA structure may be placed so that it is concealed by the outer label 18 (FIGS. 8 and 9), but upon the removal of the outer label, at least some of the non-adhesive part 17 pops-up (FIG. 10), so that it is accessible by the human hand and may be pulled on to effectuate the removal of the container from the wall. The outer label 18 also serves as a shrink-wrap in FIG. 8.

Figure 11:
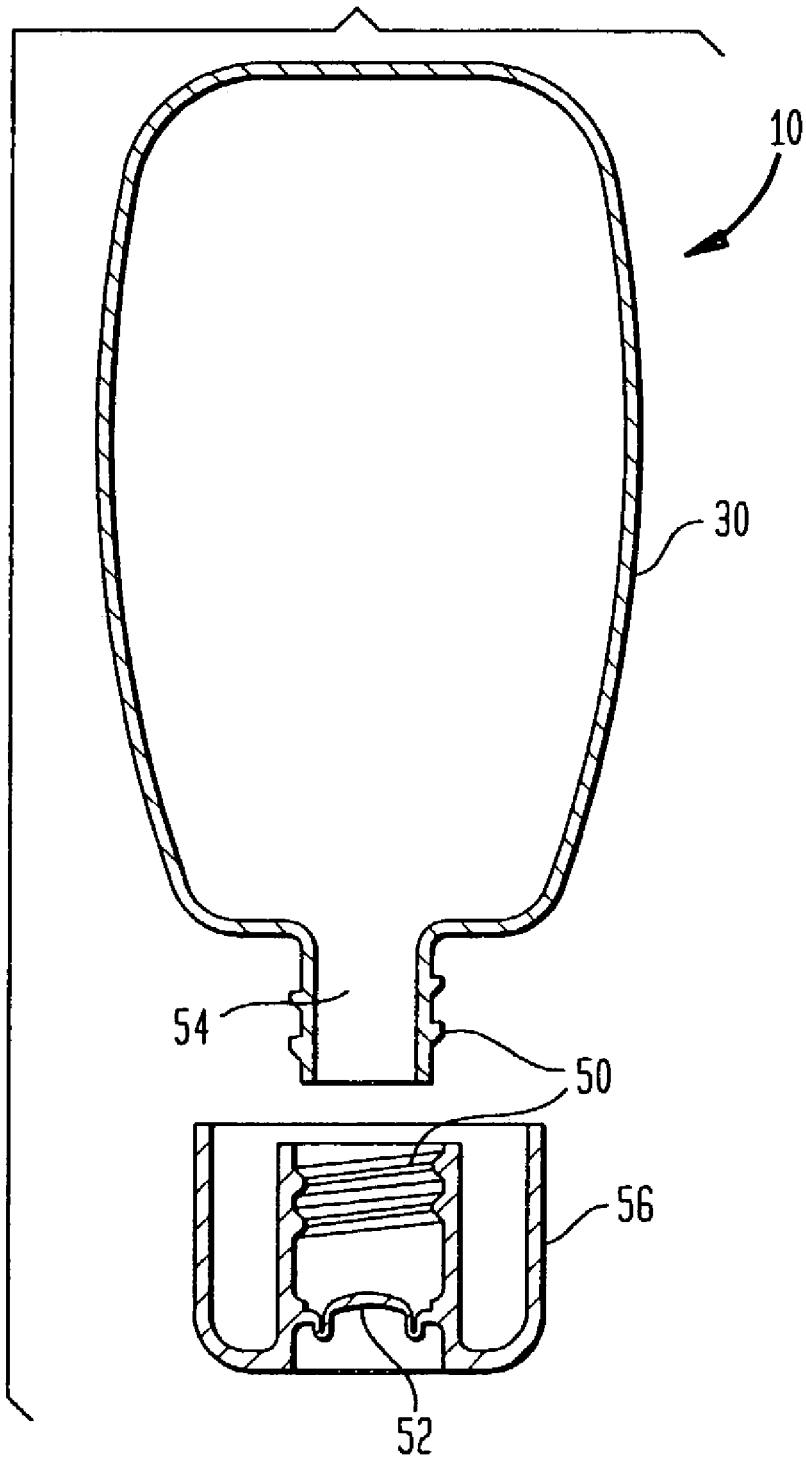

FIG. 11 shows an enlarged cross-section of the valve and the threaded attachment mechanism 50 which connects the body of the valve 56 to the container 10 over orifice 54. Container 10 also has a corrosion resistant coating 30. The location of an elastomeric seal 52 is also shown.

Figure 12:
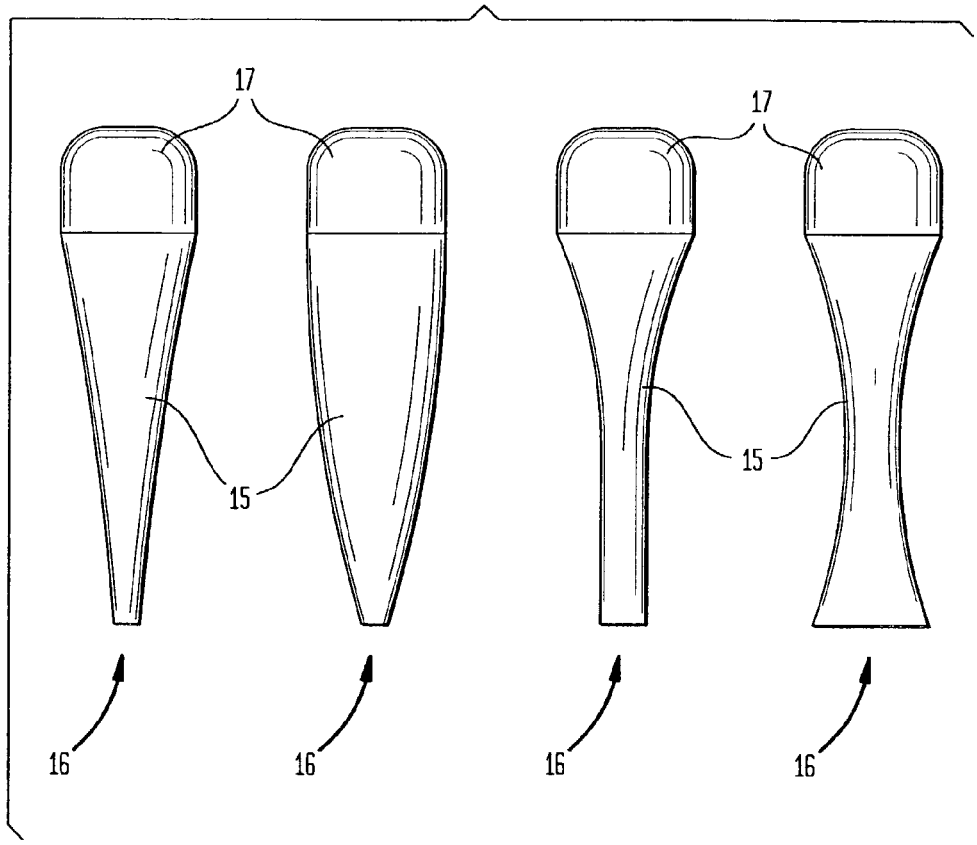
FIG. 12 is a plan view of stretch release adhesive structures according to some embodiments of the invention.

FIG. 12 illustrates some of the SRA structures, of various shapes, containing an adhesive part 15 and a non-adhesive tab 17, the latter being used to extend the adhesive tape for easy removal from the wall.

Container

The container is used for storing and dispensing a consumer product.

Containers of the present invention may be of any shape. Typically, the containers are of a suitable size to dispense a consumer product with a volume of between about 50 $cm^3$ and 1000 $cm^3$ The container may be placed on a horizontal surface or it may be wall-mounted.

The container incorporating a stretch release adhesive, for a personal care product or other material, allows such products to be used in both wet and dry environments and removed without damage to the wall, or other vertical surface that is used for mounting, and at the time of the consumer's choosing. It was unexpected that very small amounts of these stretch release adhesives would support a heavy weight and the added pressure caused by the consumer upon dispensing. It was also unexpected that very small amounts of these stretch release adhesives would support a heavy weight in the humid and wet conditions that prevail, for example, in a shower stall or bath.

It was also unexpected that there could be caused such convenience for the consumer through the use of a container removably mounted by stretch release adhesives on, for example, a bathroom wall.

The container can include one or more orifices, the size and shape of which depend upon the specific application and the physical properties of the material needing to be dispensed. For example, when the container houses a relatively low viscosity fluid, such as a shampoo, it might require a single orifice of small internal diameter with a sealing device to prevent unwanted leakage. In another application, such as a container for a solid air freshener, it might comprise a series of large elongated orifices that remain fully open throughout the use of the product.

In a preferred embodiment of the invention, the container is made of a non-corrosive material such as a metal or plastic. This enables the container to be placed in a wet or humid environment without corrosion.

Use of the Container

By virtue of containing the SRA structure, the inventive container may be mounted on a wall, preferably in an inverted configuration. By virtue of having the SRA structure concealed by the outer label, the container looks aesthetically pleasing even when stored and used on the horizontal surface such as a counter.

When a consumer desires to mount the container on a wall, the outer label is peeled off and the liner on the SRA structure is peeled off (unless the function of the SRA liner is also provided by the rear surface of the outer label in which case only the outer label is peeled off), revealing the adhesive and enabling the consumer to attach the container to the wall. When mounted on a wall, the inventive container utilizes the vertical space available and provided by walls, shower stalls, shelf-doors, closet doors, and the like, thereby completely obviating the need or necessity of horizontal supporting surfaces for storing containers, while at the same time allowing for facile and quick dispensing. The contents of the container, when wall-mounted, are preferably dispensed by applying a perpendicular force. "Perpendicular"

includes "approximately perpendicular" and means at about a 110° to about a 70° or more preferably at about a 90° angle to the vertical surface.

When the contents of the wall-mounted container are used up or when otherwise desired, the consumer pulls on the bottle, or, if accessible, on the non-adhesive part of the SRA structure, to remove the container from the wall. When the SRA structure is not accessible by human hand and is adhered directly to the container, the adhesive tape separates along its centre plane, between the adhesive surfaces, leaving part of the structure attached to the wall and the other part attached to the container. When the SRA structure is adhered to the inner label, a part or the whole of the inner label becomes separated from the side surface of the container thereby releasing it from the wall. Thereafter, the SRA structure, or what remains of it, may be removed from the wall, preferably by pulling on the non-adhesive tab of the SRA structure. When the non-adhesive part of the SRA structure is accessible by human hand, then the container is removed by pulling on the non-adhesive part.

The wall or mounting area for the container can be provided by any suitable surface in the domestic environment such as the sides of a room, shower stall, bath tub, door, window, mirror, cabinet, toilet, shelving, bookcase, partition, radiator, refrigerator and such parts of a room's construction, fixtures and appliances. The surface finish of the wall encompasses all known fabrics and materials including ceramics, glasses, metals, wood, paper and plastics and coatings thereof.

Stretch Release Adhesive Structure

"SRA structure" as used herein means a double-sided adhesive and the supporting structure for the adhesive, e.g. tape, and, optionally, one or more backing strips. As used herein, laminate means a construction that is composed of two or more layers that have been designed so as to be reversibly or irreversibly separable along an internal plane at a time of choosing.

SRA structures (e.g., tapes) are used to form powerful bonds between two opposed surfaces whilst allowing for their re-detachment by pulling on a tab which extends the tape essentially in the direction of the bond plane. This action separates the surfaces without leaving any trace or damage to the substrate or adherent. The materials and the methods by which they are made are well known in the art, for example as described in WO 92/11332, DE 3331016, DE 4233872, DE 4222849, DE 3331016, WO 94/21157 and WO 20/020124 all of which are hereby incorporated by reference in their entirety. Examples of such stretch release adhesives are commercially marketed under tradenames such as 'Command' adhesives by the 3M Innovative Properties Company and as 'tesa Power Strips' by Beiersdorf A G. Preferred classes are tapes that utilize acrylic, synthetic rubber, silicone and block copolymer based pressure sensitive adhesives in their construction.

Resistance to Water and Humidity

"Substantially resistant to water and humidity" means that a component is able to fulfil its minimum performance requirements under the conditions of either direct contact with water, or air that is saturated with water vapor, for an exposure time that is typical of the application for which it is intended. As used herein this can be assessed using a method described in a later section for quantifying the time of exposure to water that is required for the container to become detached from a vertical surface.

Method for Assessing Resistance to Water and Humidity

The method described is applicable to any combination of container and adhesive strip and the protocol is designed to define embodiments of the invention that are of practical value in the domestic environment. The experiments that were conducted in support of this application comprised a wide range of container and adhesive combinations. These included a high density polyethylene bottle filled with a hair shampoo composition (mass 433 g, approximate dimensions 220 mm×80 mm×45 mm) supported by a stretch release adhesive tape of dimensions 20 mm×20 mm×1 mm. It also included a cylindrical painted aluminium aerosol can filled with a hair conditioning composition (mass 240 g, diameter 45 mm×height 170 mm) supported by a stretch release adhesive tape of dimensions 10 mm×40 mm×1 mm. The details of the method are described in the following section.

Description of Protocol

A smooth glass plate (surface roughness Ra<0.05 micrometers) is first cleaned with ethanol (190 proof) and allowed to dry. A double sided stretch release adhesive is cut to the required dimensions and one of the protective backing strips is removed. The tape is then fixed over the centre-most point of a principal side wall of the container. The second protective backing strip is then removed from the adhesive tape and the container is pressed firmly against the glass plate, whilst supported on a measuring balance, to form an adhesive bond between the container and the glass plate. A force of 70 N is maintained for 10 seconds and then removed. The glass plate is then rotated to a vertical orientation for 5 minutes at 20 degrees C./50% RH. It is then placed within a sink and supported at an angle that is 5 degrees from the vertical and a jet of water (flow rate 4.5 litre/minute, temperature 38 degrees C.) is directed at the top of the plate, about 5 cm above the top of the container, using a flexible hose. This results in a continuous sheet of water flowing around the container and past the adhesive strip. The time required for the container to become detached under the action of its own weight is recorded. In this experiment, if the container is resistant to detachment for longer than 15 minutes it is considered to be substantially resistant to water and humidity. If it is resistant to detachment for longer than 60 minutes it is considered to be resistant to water and humidity. If it is resistant to detachment for longer than 1000 minutes or indefinitely it is considered to be highly resistant to water and humidity.

Preferably, the SRA structure is a tape comprising a silicone adhesive composition, as described in WO 02/04571, incorporated by reference herein. Thus, in one aspect, the invention features a stretch releasing adhesive tape construction that includes a silicone pressure sensitive adhesive composition that exhibits a 180° peel strength on a glass substrate at 98% relative humidity of at least about 5.47 N/dm, and a non-tacky tab. In one embodiment, the pressure sensitive adhesive composition includes a silicone polymer selected from the group consisting of silicone polyurea block copolymers, polydiorganosiloxane polymers, and mixtures thereof.

In some embodiments, the pressure sensitive adhesive composition includes a) a silicone polyurea block copolymer comprising the reaction product of i) a polydiorganosiloxane diamine having a molecular weight of at least 5,000 g/mole, and ii) a polyisocyanate, and b) from about 30% by weight to about 70% by weight MQ resin. In other embodiments, the silicone polyurea block copolymer includes the reaction product of a polydiorganosiloxane diamine having a molecular weight of at least 5,000 g/mole, a polyamine and a polyisocyanate. In one embodiment, the polyamine has a molecular weight no greater than 300 g/mole. In other embodiments, the polydiorganosiloxane diamine has a molecular weight of from about 10,000 g/mole to about 65,000 g/mole. The polydiorganosiloxane diamine can also have a molecular weight of from about 25,000 g/mole to about 50,000 g/mole.

In another embodiment, the silicone polyurea block copolymer includes the reaction product of a polydiorganosiloxane diamine having a molecular weight of from about 10,000 g/mole to about 65,000 g/mole, no greater than 3 moles polyamine (more preferably from about 0.25 moles to 2 moles polyamine), and a polyisocyanate.

In other embodiments, the pressure sensitive adhesive composition includes from about 40% by weight to about 60% by weight MQ resin. In some embodiments, the pressure sensitive adhesive composition includes from about 45% by weight to about 55% by weight MQ resin.

In some embodiments, the pressure sensitive adhesive composition exhibits a 180° peel strength on a glass substrate at 98% relative humidity of at least about 21.9 N/dm. In another embodiment, the pressure sensitive adhesive composition exhibits a 180° peel strength on a glass substrate at 98% relative humidity of at least about 32.8 N/dm.

In some embodiments, the pressure sensitive adhesive composition has a modulus at −17° C. of no greater than about $1\times10^7$ Pa. In other embodiments, the pressure sensitive adhesive composition has a modulus at 1 radian/second and −17° C. of no greater than about $5\times10^6$ Pa. In another embodiment, the pressure sensitive adhesive composition has a modulus at 1 radian/second and −17° C. of no greater than about $2\times10^6$ Pa.

In another embodiment, the tape includes a pressure sensitive adhesive foam.

In other embodiments, the tape further includes a backing and the pressure sensitive adhesive composition is disposed on the backing. In one embodiment, the backing is selected from the group consisting of elastic backings, highly extensible backings, and substantially inelastic backings, and combinations thereof. In another embodiment, the backing includes a film selected from the group consisting of single layer, multi-layer, woven, non-woven and porous films, and combinations thereof. In other embodiments, the backing includes a layer of polymeric film and a layer of polymeric foam. In another embodiment, the backing includes a layer of foam, a first film disposed on a first surface of the foam and a second film disposed on a second surface of the foam.

In some embodiments, the backing includes a treated surface, the pressure sensitive adhesive composition is disposed on the treated surface of the backing and exhibits greater adhesion to the treated backing relative to an untreated backing. In another embodiment, the tape further includes a primer composition disposed between the pressure sensitive adhesive composition and the backing. In other embodiments, a pressure sensitive adhesive composition is disposed on a first major surface of the backing and second major surface of the backing opposite the first major surface. In one embodiment, when a first substrate is bonded to a second substrate through the stretch releasing pressure sensitive adhesive tape, the stretch releasing pressure sensitive adhesive tape is capable of completely separating from one of the first substrate or the second substrate prior to completely separating from the other of the first substrate or the second substrate.

Outer Label

The outer label may be a 'shrink wrap' and/or a 'label without text' and/or a label with printed text and/or drawing. The outer label can be a cover for a full SRA structure (including the structure's own backing) or can function as both a label and as the protective backing for the adhesive in the SRA.

The outer label may be perforated, in order to allow exposure of the SRA whilst retaining a portion of the label on the container.

The outer label is preferably larger than the SRA structure, in order to conceal the SRA structure and/or render it tamper-proof. Furthermore, the outer label preferably covers at least 90% of the SRA structure, more preferably 95%, and most preferably the entire SRA structure. In a preferred embodiment of the invention, the outer label forms one side of a water-impenetrable cavity, with the other side being either the side of the container or the inner label. The advantage of water-impenetrable cavity is that the adhesive capacity of the SRA is preserved even after a prolonged use of the container, even under high humidity conditions—thus, the consumer may actually wall-mount the container even after the container has been used initially in a traditional manner, off the horizontal surface.

The outer label can be either opaque, translucent, transparent or combinations thereof in a single label.

Optional Features

In a preferred embodiment of the invention the container includes an inner label, in order to provide additional instructions, following removal of the outer label and/or to provide a mechanism by which to effect easy removal of the container from the wall.

In a more preferred embodiment of the invention, the inner label is perforated or has different portions treated with different strength adhesives (or even a portion without any adhesive on it). The purpose being that the perforated portion, or the portion with a weaker adhesive, would more selectively tear away from the bottle behind the SRA tape.

The inner label is preferably equal or larger than the SRA structure. The inner label can be smaller, larger or equal to the size of the outer label. Preferably both the inner label and the outer label are larger than the SRA structure so as to protect the stretch release adhesive structure.

If the container is not pressurised with a compressed or liquified propellant gas it is preferable that the container's side surface(s) are deformable, which means that an appreciable and recoverable change in shape can be imparted through the application of a force that is easily generated by the direct contact of a human hand.

If the container is pressurised with a compressed or liquified propellant gas it preferably includes a vertically activated or tilt activated valve. Vertically activated valve is a valve which is actuated by pressing the valve stem directly or almost directly into the container containing product. A tilt activated valve is a valve which is actuated by pressing the valve stem to one side of the container containing product.

Preferably the container valve is self-sealing, to render the container especially suitable for dispensing liquid products in inverted position. Self sealing valve refers to any valve which seals itself under the weight of the product or items that are being dispensed or on removal of an applied force. A nonlimiting list of such aerosol valves would include Seaquist Perfect Dispensing valves such as the XT-90 Toggle; the ST-70 Toggle; the VX-80 Vertical; and the AR-70 Vertical available from the Seaquist Company.

Another valve is the Super 90 Vertical, from the Precision Valve Corp. Another valve is the S-63 Tilt Action valve from the Summit Co. Another list of valves is the K Vertical; the KR Vertical; the T Tilt Action; and the TR Tilt Action all available from the Coster Co. Another valve is the Jetstar LI 98—Vertical from the Lindal Group. Examples of such non-aerosol valves include the Simplisqueeze and Simplitwist valves from Seaquist Closures. Another valve is the Zel-valve from Zeller Plastik, Libertyville Ill.

Preferably, the container is made of, or is coated with, material substantially resistant to external corrosion. Substantially resistant to external corrosion means that the container is able to be stored in a damp environment, typical of a domestic shower or washing unit, for six months without visual perception of localized areas of deterioration in the fabric of its construction. Non-limiting examples of materials which commonly offer this resistance are plastics including thermosets, thermoplastics, rubbers and metals such as aluminum and some ferrous alloys such as stainless steels and combinations thereof.

Preferably the container is designed such that it is able to be stored on a conventional horizontal surface with its orifice in both an inverted and a non-inverted orientation. Furthermore, that the design is such that when wall mounted the uppermost end does not retain water.

The self sealing valve may be attached to a conduit through which the contents of the container must pass. Where the orientation of this conduit is inclined to the vertical surface on which the container is mounted it can provide enhanced ease of dispensing by allowing more convenient access to a human hand. Inclined to the vertical surface means forming an included angle of about 10° to about 40° more preferably about 30° degrees away from the vertical surface wherein one side of said angle is said vertical surface pointing in a downward direction.

Container Contents

Consumer Product

The products suitable for dispensing from the container can be in any physical form including but not limited to liquids, solids, aerosols, gels, slurries, pastes, separable items (e.g., capsules or tablets or individually wrapped packages). In many applications where the container is to be used in a domestic shower or bathroom environment the contents will be in the form of a liquid. In this case it is found to be preferable that the liquid exhibits significant shear thinning behaviour, with a shear thinning index of between about $10^1$ and $10^9$ and more preferably between about $10^2$ and $10^6$ such that the contents are both easily dispensed and retained in the human hand. The phenomenon of shear thinning is well known by practitioners in the art of rheology and the shear thinning index as used herein is the ratio of a fluid's low to high shear rate viscosity as measured at shear rates of $10^{-3}$ and $10^3$ $s^{-1}$ respectively.

From the foregoing, it will be appreciated that although specific embodiments of the invention have been described herein for purposes of illustration, various modifications may be made without deviating from the spirit or scope of the invention.

What is claimed is:

1. A container for a consumer product suitable for both conventional storage and for mounting on a wall, the container comprising:

(a) one or more side surfaces, an end surface and a surface comprising an orifice;

(b) a stretch release adhesive structure located at least partially on the one or more side surfaces;

(c) an outer label substantially covering the stretch release adhesive structure, the outer label being removable for permitting the adhesive structure to be secured to the wall; and (d) an inner label between the side surface and the stretch release adhesive structure, wherein the inner label is perforated to define separate portions which are adhered to the at least one container surface and the adhesive structure respectively, the perforations permitting separation of the separate portions upon removal of the container from the wall.

2. The container of claim 1 wherein the inner label contains printed information.

3. The container of claim 1 wherein the inner label is larger than the stretch release adhesive structure.

4. The container of claim 1 wherein both the inner and the outer labels are larger than the stretch release adhesive structure.

5. The container of claim 1 wherein the outer label contains instructions for the use of the container.

6. The container of claim 1 wherein the stretch release adhesive structure comprises an adhesive that is substantially resistant to water and humidity.

7. The container of claim 6 wherein the adhesive is selected from the group consisting of silicone pressure sensitive adhesives.

8. The container of claim 1 comprising a construction or coating that is resistant or substantially resistant to external corrosion.

9. The container of claim 1 in which the stretch release adhesive structure is able to support the container's weight under the conditions of a constant water flow for between about 15 and about 10000 minutes.

10. The container of claim 1 in which the stretch release adhesive structure is a laminate.

11. The container of claim 1 wherein a self-sealing valve covers the orifice.

12. The container of claim 11 wherein the self-sealing valve is attached to an exit conduit through which the contents of the container must pass, and wherein the orientation of said exit conduit is inclined to the said vertical surface.

13. The container of claim 11 in which the self sealing valve is closed by a stationary layer of the product being dispensed from the container in the inverted position.

14. The container of claim 11 in which the self sealing valve comprises a multiplicity of separate openings.

15. The container of claim 1 wherein the outer label is perforated.

16. A method of removing the container of claim 1 from a wall the method comprising pulling on the container to cause the tearing of the inner label, effectuating the removal of the container from the wall.

* * * * *